US005388522A

United States Patent [19]

Martwick et al.

[11] Patent Number: 5,388,522

[45] Date of Patent: Feb. 14, 1995

[54] CARTRIDGE CASE FOR A CASED TELESCOPED AMMUNITION ROUND

[75] Inventors: Wilford E. Martwick, Minneapolis; Brian B. Tasson, Maple Grove, both of Minn.

[73] Assignee: Alliant Techsystems Inc., Hopkins, Minn.

[21] Appl. No.: 474,191

[22] Filed: Feb. 2, 1990

Related U.S. Application Data

[63] Continuation-in-part of Ser. No. 154,416, Feb. 10, 1988, Pat. No. 4,907,510.

[51] Int. Cl.[6] ..... F42B 5/045

[52] U.S. Cl. ..... 102/434; 102/430; 102/464

[58] Field of Search ..... 102/430, 433, 434, 436, 102/440, 443, 464, 469

[56] References Cited

U.S. PATENT DOCUMENTS 2,362,738 11/1944 Yarbrough ..... 102/464
4,681,038 7/1987 Washburn ..... 102/464
4,802,415 2/1989 Clark et al. ..... 102/434
4,907,510 3/1990 Martwick et al. ..... 102/434

*Primary Examiner*—Harold J. Tudor
*Attorney, Agent, or Firm*—Edward W. Hughes

[57] ABSTRACT

A cartridge case for a cased telescoped ammunition round 10. The cartridge case includes a hollow cylindrical casing 12 the axis 15 of which is also the axis of symmetry of round 10. The inner surface of casing 12 has a longitudinal groove 48 formed in it along which groove 48 casing 12 splits when round 10 is fired. A rear seal 16 closes the rear end of casing 12 and a front seal 18 closes the front end of casing 12. A hollow cylindrical control tube 20 which includes a control portion 22 and a sleeve portion 24 is secured to seals 16, 18 so that control tube 20 is symmetric with axis 15. A spring 26 interconnects control portion 22 and sleeve portion 24 of control tube 20 and applys a force substantially parallel to axis 14 to seals 16, 18 to move seals 16, 18 toward each other to minimize the distance between seals 16, 18 after the round is fired and to confine the casing between seals 16, 18.

15 Claims, 2 Drawing Sheets

CARTRIDGE CASE FOR A CASED TELESCOPED AMMUNITION ROUND

CROSS REFERENCE TO RELATED APPLICATION

This application is a continuation-in-part of application Ser. No. 154,416, filed Feb. 10, 1988, which issued as U.S. Pat. No. 4,907,510 on Mar. 13, 1990 by the same inventors.

BACKGROUND OF THE INVENTION

1. Field of the Invention

This invention is in the field of cased telescoped ammunition rounds, and more particularly relates to improvements to the cartridge cases of such rounds to facilitate removal of the fired cartridge cases from the chambers of guns having a high rate of fire.

2. Description of Related Art

Cased telescoped ammunition in which the projectile is completely enclosed, or telescoped, within the cartridge case, reduces the volume and weight of gun systems firing cased telescoped ammunition compared with the weight and volume of gun systems using conventionally shaped ammunition rounds having an equivalent rate of fire. The reduced weight and volume for equivalent fire power makes such gun systems desirable for mounting in aircraft, tanks, and other mobile combat vehicles. Where a gun system includes a gun and its associated ammunition storage and feed mechanisms. The benefits of using cased telescoped ammunition in a gun system derive primarily from the cylindrical shape of the cartridge case of each such round.

When a cased telescoped ammunition round is fired, the projectile is initially accelerated by a booster charge to close, or to obturate, the barrel of the gun before the main propellant charge is ignited. A control tube is commonly used to control the initial movement of the projectile. A booster charge is located in the control tube and is separated by the tube from the main propellant charge. Products of the ignited booster charge are initially confined within the control tube by a booster piston attached to the base of the projectile. Main charge ignition does not occur until the advancing piston clears the tube, or exposes or unblocks, ignition ports in the wall of the control tube, which permits products of the burning booster charge to ignite the main charge. Ignition of the main charge is controlled by the position of the projectile and its booster piston relative to the control tube.

The external surfaces of the cartridge case of a typical cased telescoped ammunition includes a cylindrical outer casing and two end seals, a front seal and a rear seal. Each such round is loaded into a cylindrical gun chamber, or chamber, of the gun from which the round is to be fired, and from which the spent cartridge case is removed, or unloaded, after firing before another cycle of loading, firing and unloading begins. In guns from which such rounds are typically fired, the chamber housing in which a number of gun chambers may be formed can take the form of a cylinder which is rotated about its axis of symmetry similar to the rotation of the cylinder of a hand held revolver. In a gun system mounted in an aircraft, for example, the rounds are mechanically loaded into a given gun chamber when that chamber has a given orientation, position, or station, relative to the gun barrel. The chamber is then rotated to bring the loaded gun chamber into alignment with the gun barrel ready for firing. After firing, the chamber housing is again rotated to another position so that the gun chamber with the cartridge case of the fired round, the spent cartridge case, can be removed from the gun chamber. Alternatively, the chamber housing may be move linearly with respect to the gun barrel to position a gun chamber in the gun's chamber housing in a loading station where a round can be loaded into the chamber, the chamber housing is then moved to align the loaded gun chamber with the gun barrel. When the round is fired, the chamber housing is moved so that the gun chamber with the spent cartridge case is at its unloading station where the spent cartridge case is removed from the chamber prepatory to another round being loaded into it. In such a gun, the loading and unloading stations for a given chamber may be the same. Cased telescoped ammunition obviously can also be fired from more conventional guns firing projectiles of from 20 to 45 mm. for example.

When the interior of the cartridge case is pressurized by the burning of the propellant within the cartridge, the outer skin, or cartridge casing, which serves to contain the propellant and properly locate the end seals within the gun chamber so that the lips of the seals which are designed to expand will properly seal the ends of the gun chamber to prevent gun gas from escaping between the the chamber housing and the breech and barrel faces of the the gun. The pressure created by the burning propellant forces the end seals apart until they are constrained by the breech face of the gun forming one end of the chamber and by the the barrel face of the gun barrel which forms the other end of the chamber. This pressure also forces the outer casing, or skin, of the cartridge case radially outward into intimate contact with the inner cylindrical surface of the cylindrical housing forming the gun chamber. After such contact has been achieved, the pressure produced by the burning propellant acts to elastically deform the barrel housing, enlarging the diameter of the gun chamber and forcing apart the breech face and the barrel face of the gun. When the pressure within the cartridge case is relieved by the exit of the projectile from the muzzle of the gun barrel, the gun and chamber revert to their unpressurized dimensions. However, changes in the dimensions of the cartridge case experienced during firing cause nonelastic changes in the dimensions of the cartridge case, so that the dimensions of the cartridge case do not return to the dimensions they possessed prior to the round being fired.

To extract a spent cartridge case after it has been fired, it is necessary in guns with movable chamber housings to move the chamber housing so that the gun chamber in which the spent cartridge case is located can be moved to its unloading position, or station. For such movement to take place as quickly as possible while requiring the minimum amount of force to accomplish such movement within the time allotted for such a move, it is necessary that there be sufficient clearance between the end seals of the spent cartridge and the breech face and the barrel face of the gun to minimize frictional resistance to the movement of the chamber housing. To quickly and easily remove the spent cartridge case from the gun chamber, it is important that the cartridge casing not press against the inner cylindrical surface of the gun chamber, and that the spent cartridge case be sufficiently intact so that all components of the spent cartridge case can be removed together, or as an entity.

Because the elastic deformations of the typical gun firing cased telescoped ammunition are so large, there is a need for an improved cartridge case for cased telescoped ammunition rounds that provides adequate and proper clearance between the end seals and the breech face and the barrel face of the gun after the round has been fired as well as between the cartridge casing and the surface of the gun chamber while maintaining the integrity of the spent cartridge casing to facilitate its removal.

To reduce the pressure exerted by the outer casing, or skin, of the cartridge case of a telescoped ammunition round on the surface of the gun chamber within which the round is fired, and thus the force needed to remove the spent cartridge case, the skin, or outer casing, is typically split longitudinally which prevents any pressure being exerted by the outer casing against the inner surfaces of the gun chamber after the gun chamber returns to its initial dimensions, the dimensions it had immediately prior to the round being fired. In such rounds the end seals are free to move relative to the outer casing which requires special means to maintain the integrity of the casing i.e., the necessary degree of connection between the end seals and the split casing so that they can be removed as a single entity. Typically, the joint between the end seals and the casing includes a sealant to prevent moisture and contaminants from entering the round, but such joints are not strong enough to maintain the integrity of a spent cartridge case with the degree of reliability required so that the problem of removing a spent cartridge case as a single entity quickly, and completely with a minimum amount of energy is not consistently achieved.

SUMMARY OF THE INVENTION

The present invention provides an improved cartridge case for a cased telescoped ammunition round. The cartridge case of the round includes a hollow cylindrical outer casing the axis of which is also the axis of symmetry of the round, front and rear seals, a control tube and an igniter. The inner surface of the outer casing is scored longitudinally to permit the casing to split when the round is fired. A rear seal closes the rear end of the outer casing and a front seal closes the front end of the outer casing with front and rear edges of the outer casing fitting into the seals. The hollow cylindrical control tube includes a control portion and a sleeve portion. The control portion of the control tube is attached to the rear seal and the sleeve portion is attached to the front seal of the cartridge case so that the control tube is symmetric with the axis of symmetry of the round. A projectile is positioned in the sleeve portion of the control tube, and a booster piston, which is secured to the base of the projectile is located in the control portion of the control tube. A booster propellant is positioned within the control tube between the primer, or igniter, and the free end of the booster piston. The primer which ignites the booster propellant is mounted in the rear of the control portion of the control tube. The main propellant charge is positioned around the control tube within the casing and between the front and rear seals. A spring interconnects the control portion and the sleeve portion of the control tube to exert a force on the front and rear seals acting to move the seals toward one another so that the distance between the seals after a round is fired provides adequate clearance between the seals and the breech and barrel faces of the gun from which the round is fired. As a result, the seals do not press against the barrel face and breech face of the gun after the cartridge is fired, and no significant frictional force resisting movement of the chamber housing is caused by the seals of the cartridge pressing against the breech and barrel faces of the gun. The connection between the seals of the casing provided by the control tube maintains the integrity of the spent cartridge case by mechanically confining the casing between the end seals so the the spent cartridge case can be removed as an entity from the gun chamber.

It is, therefore, an object of this invention to provide an improved cartridge case for a cased telescoped ammunition round in which the control tube which is connected to the front and rear seals of the cartridge case includes a spring for exerting a force which acts to move the seals toward one another and so that the length of the round returns to its original length after being fired.

It is another object of this invention to provide a cartridge case for a cased telescoped ammunition round that facilitates removal of the cartridge case from the gun chamber from which the round was fired.

It is yet another object of this invention to provide a cartridge case for a cased telescoped ammunition round in which the casing of the cartridge case splits when the round is fired and the connection between the ends seals provided by the control tube permits the spent casing to be unloaded as an entity.

BRIEF DESCRIPTION OF THE DRAWINGS

Other objects, features and advantages of the invention will be readily apparent from the following description of a preferred embodiment thereof, taken in conjunction with the accompanying drawings, although variations and modifications may be affected without departing from the spirit and scope of the novel concepts of the disclosure, and in which.

DETAILED DESCRIPTION

Figure 1:
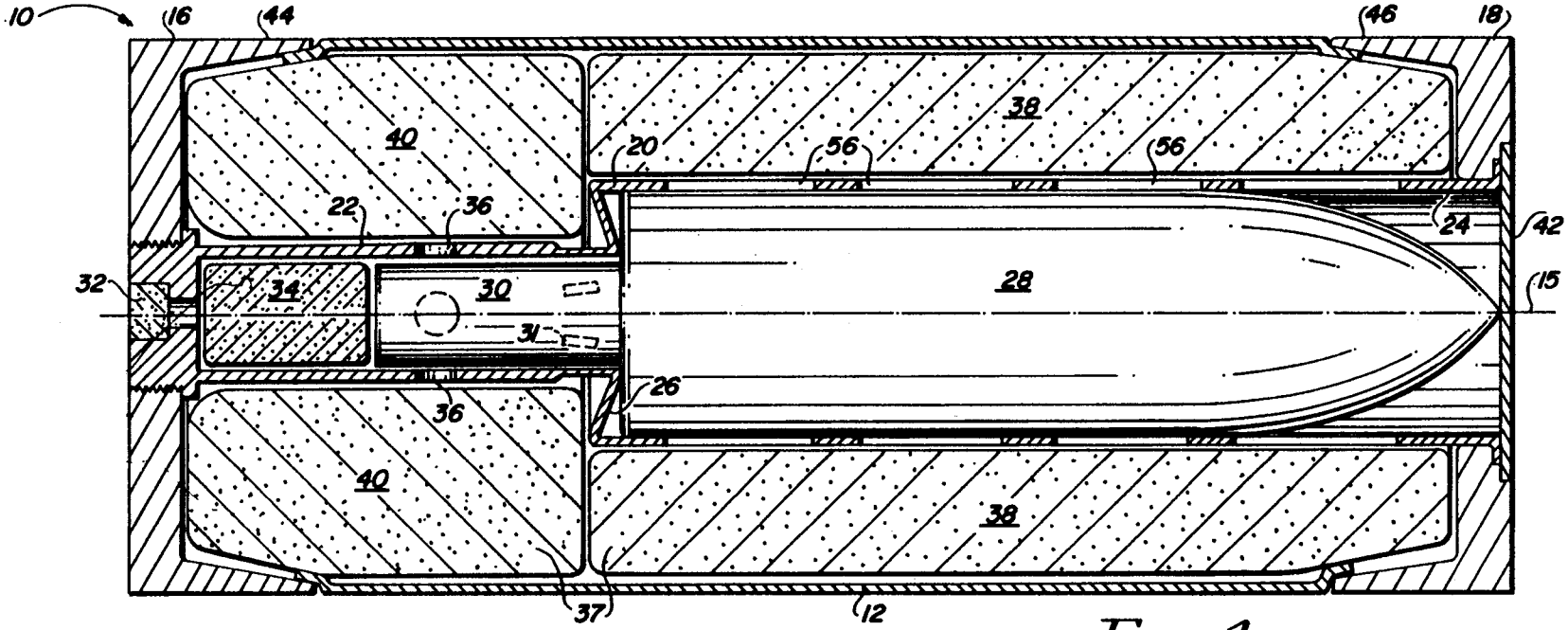
FIG. 1 is a section of a cased telescoped ammunition round with a preferred embodiment of a cartridge case embodying this invention.
Figure 5:
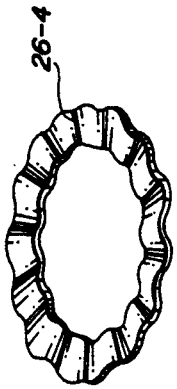
FIG. 5 is a perspective view of the spring of the embodiment illustrated in FIG. 4.

In FIG. 1 cased telescoped ammunition round 10 has a right circular cylindrical outer casing, or skin, 12 the rear and front edges 13, 14 of which are tapered inwardly. Axis 15 of round 10 is the axis of symmetry, Or longitudinal axis of casing 12. Rear seal 16 closes off the rear end of casing 12, and front seal 18 closes off the front end of casing 12. Control tube 20 includes two portions, a control portion 22 of control tube 20 and a sleeve portion 24. Control portion 22 and sleeve portion 24 are each right circular hollow cylinders of differing diameters. A spring 26 interconnects the front end of control portion 22 and the rear end of sleeve portion 24 of control tube 20. Spring 26, in the preferred embodiment is a frustum of a right circular cone and is made integral with portions 22, 24 of control tube 20 of a material having the desired physical characteristics, such as 17-4PH steel. Spring 26 is commonly known as a "Belleville" spring.

When round 10 is fully assembled, control portion 22 is secured to rear seal 16 and sleeve portion 24 is secured to front seal 18 so that the axes of symmetry, or longitudinal axes of portions 22 and 24 substantially coincide with axis 15. Projectile 28 is located within sleeve portion 24 of control tube 20, and booster piston 30, which is mounted on the base of projectile 28, is positioned within control portion 22. Spring fingers 31 are formed in control portion 22 to press against booster piston 30 and thus resist movement of projectile 28 within control tube 20 during normal handling prior to being fired. Primer, or igniter, 32 is mounted in the rear end of control portion 22 of control tube 20 and booster charge 34 is positioned within control portion 22 between booster piston 30 and igniter 32. Ignition ports, or vents, 36 are formed through the side walls of control portion 22. Vents 36 are initially blocked, or closed, by booster piston 30. Two segments of the main propellant 37 of round 10, front segment 38 and rear segment 40 are positioned around control tube 20 within casing 12 and between end seals 16 and 18. Segments 38, 40 are formed by consolidating propellant grains. The inner diameter of front segment 38 is greater than that of rear segment 40 so that forward segment 38 can fit around sleeve portion 24 of control tube 20 which has a greater diameter than control portion 22. The central opening in front seal 18 is closed by environmental seal 42 which is made of a suitable material, such as aluminum foil. The function of seal 42 is to prevent elements of the environment external to round 10 such as moisture, dirt, etc. from entering round 10 and adversely impacting the performance of the round.

Rear seal 16 is provided with a lip 44 and front seal 18 is provided with a lip 46. When round 10 is assembled, the rear and front inwardly tapered edges 13, 14 of casing 12 fit within lips 44, 46 of seals 16, 18. The joints between seals 16, 18 and edges 13, 14 of casing 12 are environmentally sealed by a sealant such as a room temperature vulcanizing silicone which is not illustrated. The inner surface of casing 12 is scored, or has a longitudinal groove 48 formed in it. Groove 48 concentrates the stress applied to casing 12 when round 10 is fired to cause casing 12 to fail, or split, along groove 48.

Round 10 is assembled by securing the front end of sleeve portion 24 of control tube 20 to front seal 18, by swaging, for example. Booster charge 34 is positioned in control portion 22 and projectile 28 with its booster piston 30 are placed within sleeve portion 24 and control portion 22 of control tube 20 as illustrated in FIG. 1. The front and rear segments 38, 40 of main propellant 37 are placed around control tube 20. Outer casing 12 is slipped over main propellant 37 with its tapered front edge 14 positioned within lips 46 of front seal 18 as illustrated in FIG. 1. Rear seal 16 is positioned so that tapered rear edge 13 of casing 12 is positioned within lips 44 of rear seal 16. Seal 16 is then secured to control tube 20, by threads to reduce the overall length of round 10 to its desired dimension which stresses spring 26 or spring 26 is prestressed, so that a force is exerted on front and rear seals 18, 16 acting to move seals 16, 18 toward one another.

Figure 4:
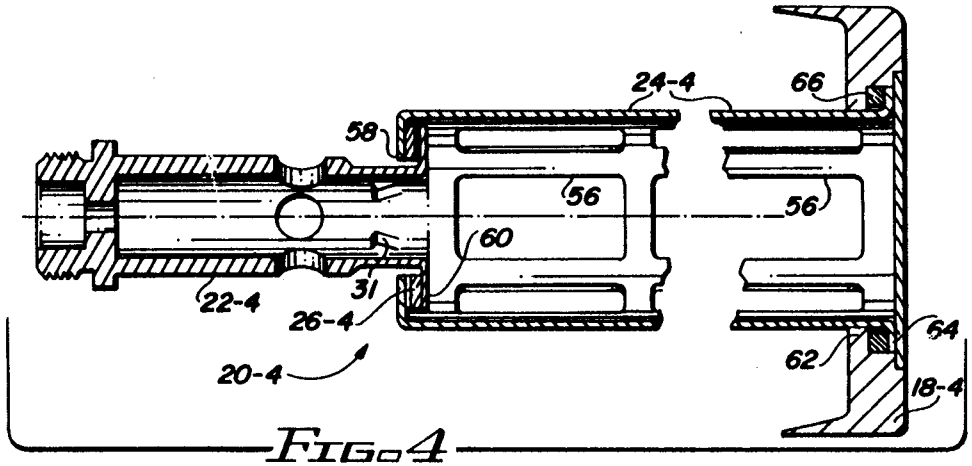
FIG. 4 is an enlarged fragmented sectional view of a third embodiment of the control tube of the cartridge case of this invention.
Figure 2:
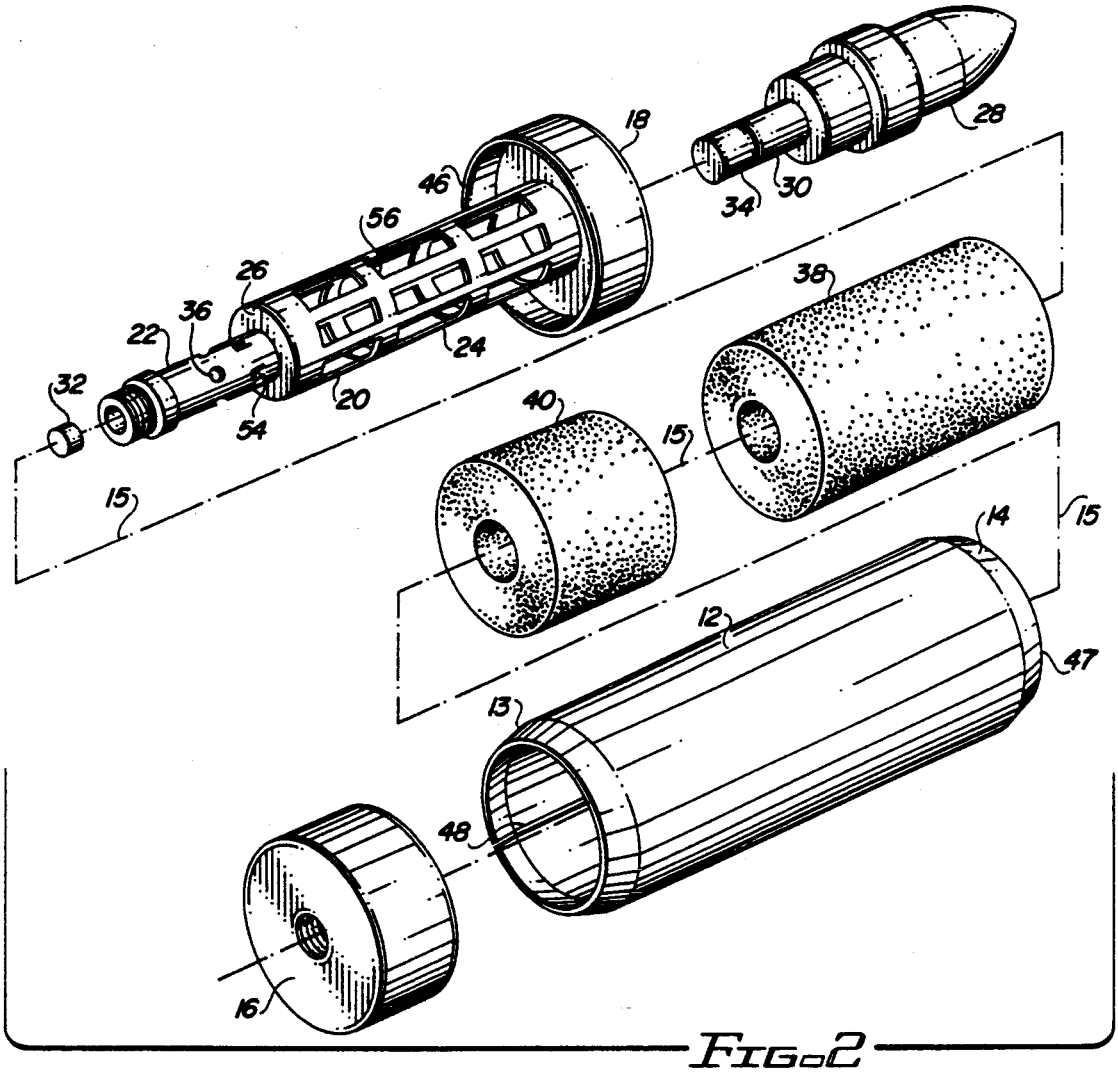
FIG. 2 is an exploded view of the embodiment of FIG. 1.
Figure 3:
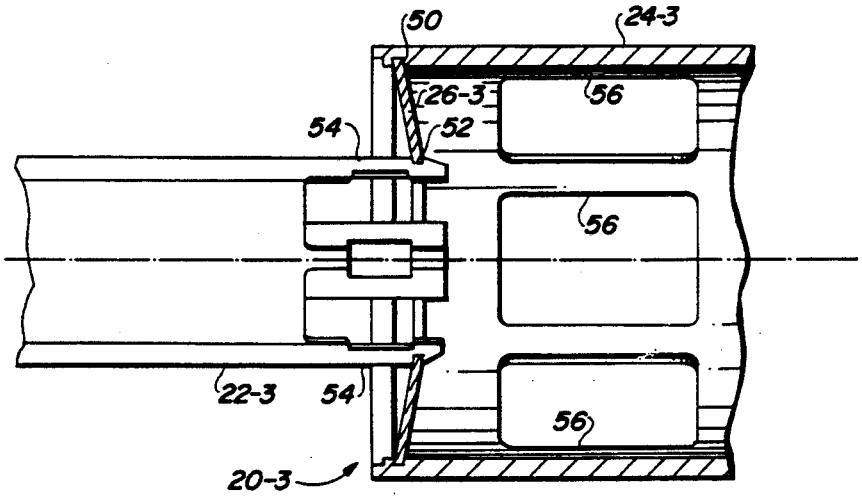
FIG. 3 is an enlarged fragmented sectional view of a second embodiment of the control tube of the cartridge case of this invention.

In the preferred embodiment spring 26 is formed integrally with control portion 22 and sleeve portion 24 of control tube 20. In FIG. 3 a second embodiment of the control tube is illustrated in which spring 26-3 which also is a "Belleville" type, is a separate element. The outer circumference of spring 26-3 fits into a circumferential groove 50 formed in the inner surface of sleeve portion 24-3 of control tube 20-3 while the inner circumference fits into slots 52 cut into flexible fingers 54 formed at the front end of control portion 22-3 of control tube 20-3. Numerous openings, or vents, 56 are formed in sleeve portion 24, as is illustrated in FIG. 3, and FIG. 4. An example of a spring 26-3 for the embodiment illustrated in FIG. 3 has an out side diameter of 1.070 in., an internal diameter of 0.550 in., is made for 17-7 PH stainless steel, and has a height of 0.045 in.

In a third embodiment of the control tube illustrated in FIG. 4, the control portion 22-4 and sleeve portion 24-4 of control tube 20-4 are separate. The rear end of sleeve portion 24-4 has an inwardly extending flange 58, and the front end of control portion 22-4 of control tube 20-4 is provided with an outwardly extending flange 60. Spring 26-4 is a wave washer which is positioned around control portion 22-4 and between flanges 60 and 58. The dimensions and materials of spring 26-4 can be substantially the same as those of spring 26-3.

When round 10 is assembled using control tube 20-4, spring 26-4 is compressed so that after the round is fired end seals 16, 18 will be subject to a force to cause the distance between them to return to their status prior to being fired. This restoring force can be increased by forming cooperating flanges 62, 64 on the front seal 18-4 and the front end of sleeve portion 24-4 and compressing wave spring 66 between flanges 62, 64 when round 10 is assembled.

In the typical gun system which is not illustrated, a round 10 is loaded into a gun chamber in a chamber housing of the gun. The housing is moved to align the chamber containing round 10 with the gun barrel. The gun chamber is defined by a breech face, the inner cylindrical surface of the gun chamber, and the face of the gun barrel. Round 10 is fired by a mechanism in the breech of the gun which drives a firing pin into primer 32, or by discharging an electrical current through primer 32 to initiate primer 32. Primer 32, when initiated, ignites booster charge 34. Pressure of the gases released by burning booster charge 34 act on the exposed end of booster piston 30 to accelerate projectile 28 out of round 10 into the forcing cone of the gun barrel. As projectile 28 moves forward, booster piston 30 exposes, or unblocks, vents 36 in the control portion of control tube 20 so that the burning booster charge 34 ignites main propellant 37. The burning propellant 37 produces gases having a very high pressure and temperature that act against seals 16, 18, casing 12 as well as projectile 28 to accelerate projectile 28 to a desired muzzle velocity as projectile 28 exits the gun barrel.

As the pressure of the gases produced by the burning propellant increases, the lips 44, 46 of end seals 16, 18 expand to seal the ends of the gun chamber so that little or no gun gas can escape from the gun chamber between the chamber housing and the breech and barrel faces of the gun. This pressure forces end seals 16, 18 apart until they are constrained by the breech and barrel faces of the gun. This pressure also forces the outer casing 12 outwardly against the inner cylindrical surface of the housing in which the gun chamber is formed. After such contact has been established and as the pressure of the gases within the cartridge approach their maximum this pressure is sufficient to elastically deform the barrel housing, enlarging the diameter of the gun chamber and forcing apart the breech and barrel faces of the gun. The stress on casing 12 is sufficient to cause casing 12 to split along groove 48, so that no fixed connection exists between seals 16, 18 and casing 12. After projectile 28 exits the muzzle of the barrel, the pressure within the cartridge case which includes outer casing 12, end seals 16, 18, control tube 20 and primer 32 quickly decreases toward ambient at which time the gun and its chamber housing revert to their unpressurized dimensions.

Since casing 12 has split along longitudinal groove 48, any nonelastic deformation of casing 12 occurring during firing will not result in casing 12 pressing against the inner surface of the gun chamber from which round 10 is fired. Thus, substantially no frictional force is created by casing 12 pressing against the surface of the gun chamber to resisting removal of the cartridge case.

The various embodiments of spring 26 of control tube 20 act to draw end seals 16,18 toward each other so that there is no significant frictional force opposing movement of the chamber housing of the gun caused by the seals 16, 18 pressing against the breech and barrel faces of the gun. Since seals 16, and 18 are secured to the ends of control tube 20 and the seals are biased toward each other and the tapered edges 13, 14 of casing 12 are within the lips 44, 46 of end seal 16, 18, the force of spring 26 applied to seals 16, 18 maintains the integrity of the spent cartridge case so that all the elements of the spent cartridge case can be removed from a gun chamber as an entity and with a minimum expenditure of energy.

From the foregoing it should be evident that various modification can be made to the described invention without departing from the scope of the present invention.

What is claimed is:

1. A cased telescoped ammunition round comprising:

a hollow cylindrical casing having a front edge a rear edge, and an axis of symmetry;

a rear seal within which the rear edge of the casing fits;

a front seal within which the front edge of the casing fits;

a hollow cylindrical control tube including a hollow cylindrical control portion having a front end and a rear end, the rear end of the control portion being secured to the rear seal so that the control portion of the control tube is substantially symmetrical with respect to the axis of symmetry; and a hollow cylindrical sleeve portion having a front end and a rear end, the front end of the sleeve portion being secured to the front seal so that the sleeve portion is substantially symmetrical with respect to the axis of symmetry; and spring means mounted between the front end of the control portion and the rear end of the sleeve portion of the control tube, said spring means being prestressed so that a force is exerted on the front and rear seals, said force acting to move the seals toward one another;

a projectile having a base and a nose;

a booster piston mounted on the base of the projectile, said projectile being positioned in the sleeve portion of the control tube with the booster piston projecting into the control portion of the control tube;

a main propellant charge positioned around the control tube, within the casing and between the front and rear seals;

a booster propellant positioned within the control tube; and primer means mounted on the control portion of the control tube for igniting the booster propellant charge when initiated.

2. The cased telescoped ammunition round of claim 1 in which the spring means is formed integrally with the control portion and the sleeve portion of the control tube.

3. The cased telescoped ammunition round of claim 2 in which the spring means is a "Belleville" spring.

4. The cased telescoped ammunition round of claim 1 in which the spring means is a separate element of the control tube.

5. The cased telescoped ammunition round of claim 4 in which the spring means is a "Belleville" spring.

6. The cased telescoped ammunition round of claim 5 in which the spring means is a wave washer.

7. The cased telescoped ammunition round of claim 6 in which a second wave washer spring is positioned between the front seal and the sleeve portion of the control tube to bias the front seal toward the rear seal.

8. A cartridge case for a cased telescoped ammunition round comprising:

a hollow cylindrical outer casing having a front edge, a rear edge and an axis of symmetry;

a rear seal within which the rear edge of the casing fits;

a front seal within which the front edge of the casing fits;

a hollow cylindrical control tube having a control portion having a front end and a rear end, and a sleeve portion having a front end and a rear end, the rear end of the control portion portion being secured to the rear seal so that the control portion of the control tube is substantially symmetrical with respect to said axis of symmetry; the hollow cylindrical sleeve portion being secured to the front seal so that the sleeve portion is substantially symmetrical with respect to the axis of symmetry; and spring means being positioned between the front end of the control portion and the rear end of the sleeve portion and being prestressed so that a force is applied to the front and rear seals acting to move the seals toward one another and to retain the outer casing between the seals; and a primer mounted in the rear end of the control portion of the control tube.

9. A cartridge case as set forth in claim 8 in which the spring means is formed integrally with the control portion and the sleeve portion of the control tube.

10. A cartridge case as set forth in claim 9 in which the spring means is a "Belleville" spring.

11. A cartridge case as set forth in claim 8 in which the control portion, the sleeve portion and the spring means each is a separate element secured to each other by the spring means to form control tube.

12. A cartridge case as set forth in claim 11 in which the spring means is a "Belleville" spring.

13. A cartridge case as set forth in claim 11 in which the spring means is a wave washer.

14. A cartridge case as set forth in claim 13 in which a second wave washer is positioned between the front seal and the sleeve portion of the control tube, said second wave washer being prestressed for biasing the front seal toward the rear seal 16.

15. A cartridge case for a cased telescoped ammunition round comprising:

a right circular cylinder outer casing having a rear edge and a front edge, said edges being tapered inwardly, a longitudinal axis, and a length parallel to the longitudinal axis;

a rear seal having a circumferential tapered lip, the rear edge of the casing positioned within the tapered lip of the rear seal;

a front seal having a circumferential tapered lip, the front edge of the casing positioned within the tapered lip of the front seal;

a hollow cylindrical control tube having a control portion, a sleeve portion, and spring means, the control portion having a front end and a rear end, the rear end of the control portion being threadably secured to the rear seal, the sleeve portion of the control tube having a front end and a rear end, the front end of the sleeve portion being secured to the front seal so that the control portion and the sleeve portion of the control tube are substantially symmetric with respect to the longitudinal axis and so that the front seal can move toward the rear seal; spring means being mounted between the front end of control portion and the rear end of sleeve portion, said spring means being stressed when the cartridge is assembled so that a force is applied to the front and the rear seals acting to move the front and rear seals toward one another and to retain the outer casing between the front and rear seals; and an igniter mounted in the rear end of the control tube.

* * * * *